United States Patent [19]

Herre et al.

[11] Patent Number: 4,702,461

[45] Date of Patent: Oct. 27, 1987

[54] CHARGING ELECTRO FURNACES

[75] Inventors: Emil Herre, Herne; Gerd Herre, Oberhausen; Guenter Zimmer, Moers; Hermann Cepin, Duisburg, all of Fed. Rep. of Germany

[73] Assignee: Mannesmann AG, Duesseldorf, Fed. Rep. of Germany

[21] Appl. No.: 611,362

[22] Filed: May 16, 1984

[30] Foreign Application Priority Data

May 18, 1983 [DE] Fed. Rep. of Germany ..... 3318475

[51] Int. Cl.[4] ..... C22B 4/08

[52] U.S. Cl. ..... 266/216; 266/287; 373/81

[58] Field of Search ..... 266/287, 216, 265; 373/80–82

[56] References Cited

U.S. PATENT DOCUMENTS

| | | | |
|---|---|---|---|
| 3,370,119 | 2/1968 | Grimm et al. | 373/82 |
| 3,564,103 | 2/1971 | Brachschob et al. | 373/82 |
| 3,604,826 | 9/1971 | Muller et al. | 373/82 |

FOREIGN PATENT DOCUMENTS

| | | | |
|---|---|---|---|
| 0289128 | 5/1971 | U.S.S.R. | 266/216 |

*Primary Examiner*—L. Dewayne Rutledge
*Assistant Examiner*—S. Kastler
*Attorney, Agent, or Firm*—Ralf H. Siegemund

[57] ABSTRACT

An electro furnace for metallurgic operations has its top connected to a vertically extending cylinder, into which a charge pipe leads at an oblique angle. A ceramic plug glides in the cylinder in piston like fashion for selective opening and closing the opening from said charge pipe. Any burden and ore mixture will therefore fall freely from the charge pipe whenever the plug is shifted up to open the gate.

2 Claims, 3 Drawing Figures

1
2
3
4
10
11

13
3'
1
2
1000°-
1200°C
5
11'
1600°-1700°C 1
2
3''
6
5
11''

CHARGING ELECTRO FURNACES

BACKGROUND OF THE INVENTION

The present invention relates to the charging of a metallurgic furnace with burden, a mixture of ore or the like. Arc furnaces, particularly furnaces provided for the reduction of ore are usually provided with equipment for charging and feeding by means of which the charge is transferred from a storage facility into the interior of the furnace. Tubular channels, ducts or the like are usually used in this case, and they are situated so as to lead to the vicinity of the electrodes in the interior of the furnace in order to charge the furnace as close as possible to the electrodes. These feeding and charging tubes or pipes are exposed to rather high temperature which may reach up to or even above 1,600° C. depending upon the atmosphere maintained in the furance.

It is known, for example, through the Norwegian Pat. No. 138,482, to provide particular construction for the interruption of the charging process by including slides or gate elements in the charging tubes. These slides or gates are in this case lined in a refractory fire-proof manner, so that they can take the high temperatures prevailing in the furnace. The construction and particularly the mounting of such a slide is quite complex. It was observed that primarily due to the complexity of the construction these slides or gates often jam, because ore or burden parts somehow lodge between the slide or gate and its guide and rail facility.

DESCRIPTION OF THE INVENTION

It is an object of the present invention to provide a new and improved facility for charging metallurgical furnaces which permits controlled interruption of the charging flow in a charge and feed tube or pipe which is of considerable simpler construction as compared with the prior art devices and is capable of withstanding high temperatures while jamming f.ex. through burden and charge parts is avoided.

It is a particular object of the present invention to provide a new and improved structure for charging metallurgical furnaces and including particularly at least one charge tube or pipe which runs through the top of the furnace and is connected externally to the furnace with a charge storage facility and which furthermore includes a construction for interrupting in a controller manner the charge flow.

In accordance with the preferred embodiment of the invention it is suggested to provide an upright cylinder that leads to the top of the furnace vessel, and a charge pipe ends obliquely at that cylinder. A piston is inserted into that cylinder to close the charge tube while retraction of the piston opens the charge flow. Preferably the piston is a ceramic-monolithic plug element and the cylinder is preferably arranged at an acute angle in relation to the charge tube or pipe.

The particular arrangement of the piston as a closing gate in a separate perpendicular cylinder avoids that any charge particles can wedge between piston and cylinder wall, because any such particle that may for some reason be placed in upward direction will fall under its own weight back into the feed pipe. By this simple expedient clamping and other interference in the gate and closing operation is avoided. Since the piston is constructed from a ceramic material it will take the furnace temperature without any problems.

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Figures 1, 2, 3:
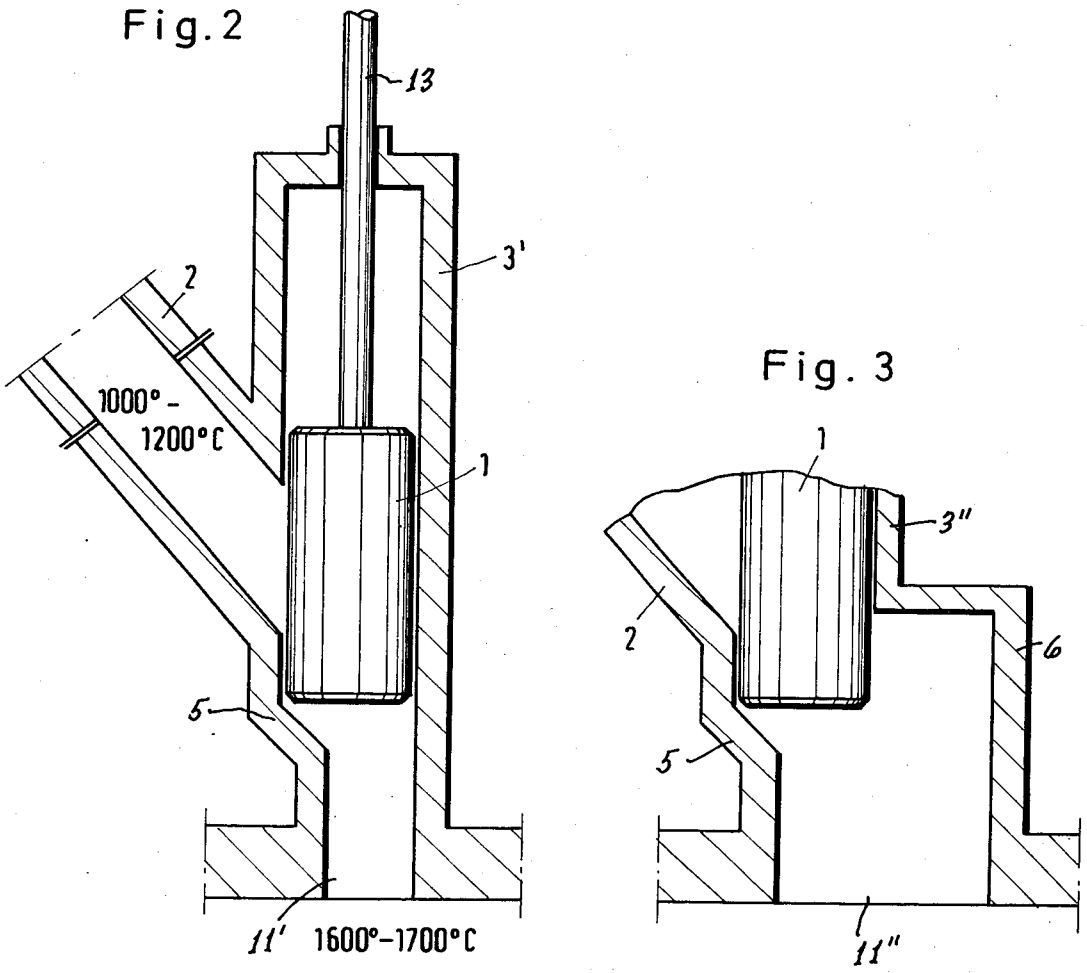
FIGS. 1, 2 and 3 are respectively side views through constructions in accordance with the preferred embodiment of the present invention, for practicing the best mode thereof, the figures differ in certain structural details.

Proceeding now to the detailed description of the drawings, all of the figures show a porition of a charge tube or pipe 2, but it is understood that the charge tube or pipe connects at its upper end to a charge facility such as a bin or a hopper of conventional design. The purpose of the facility is to charge a metallurgical furnace having a top or cover part 10 with an opening 11 through which the charge will drop into the interior of the furnace. The charge pipe 2 communicates with that opening 11 but there is a gate element interposed.

As shown for example in FIG. 1, the charge pipe 2 does not merge directly into the furnace wall or cover 10, but it merges in a vertical cylinder or auxiliary tube 3 at an oblique orientation, the angle vis-a-vis the vertical being an acute one. The charge opening 11, leading into the furnace is the lower end of cylinder 3.

This cylinder 3 receives a ceramic plug-like piston extending from an actuator rod 13 and which can glide or slide up or down in the vertically disposed cylinder 3. A step or stop projection 4 prevents the piston from dropping too deeply into the cylinder 3 and thereby defines in fact a gate closing position for interrupting the flow of charge from the charge pipe 2 into the cylinder 3 and the opening 11. The ceramic plug is configured so that it will in fact close the charge pipe 2 completely when seated on the stop 4.

The arrangement shown in FIG. 2 illustrates the cylinder 3' in a slightly different configuration, there is a narrowing of the interior opening 11' of the cylinder 3 defining a step 5, which establishes the lower limit of the position of piston 1. Finally FIG. 3 illustrates a similar stop or step portion 5 of the cylinder 3'', but the opposite side of that cylinder is enlarged into a chamber 6 to thereby enlarge the charge opening 11'', particularly as compared with the narrowed opening 11' as per FIG. 2.

It can be seen that in all instances the charge pipe 2 and the cylinder 3, 3' or 3'' have an accute angle with the cylinder being arranged strictly vertically. Therefore the burden or ore mixture that enters the system through the charge pipe 2 cannot but fall down because there is no place where any residual charge may lodge for clamping the piston and jamming it in the cylinder.

The stop 4 may at times receive a certain amount of burden which may prevent the piston from assuming its lower most position, but this slide deficiency can readily be compensated for by providing the step 4, sufficiently below the opening of the charge pipe 2 into the cylinder 3, so that under no circumstances will it occur that the piston run will not close the opening of the charge pipe 2 into the cylinder 3 completely. Also, the stop 4 may be very narrow so that it will not serve adequately as a free support for ore particles. The inclined stop 5 is sufficiently steep so that ore will not be retained.

As stated the piston itself is made of a ceramic monolithic plug. Conceivably several of such plugs may be assembled from different drums under utilization of a variety of grades in the material. This way it is possible to optimize the withstanding of the plug of high temperature. The piston operation and actuation thereof is very simple in principle and follows conventional procedure.

The invention is not limited to the embodiments described above, but all changes and modifications thereof not constituting departures from the spirit and scope of the invention are intended to be included.

We claim:

1. Apparatus for feeding a metallurgical furnace from the top, comprising:

a top structure of the metallurgical furnace;

a cylinder extending upwardly and upright from the top structure of the furnace and having at its lower end a charge opening leading into the interior of the furnace;

a charge pipe for feeding raw charges to the furnace and extending obliquely from said cylinder for connection to a charge feeding facility;

a cermaic piston slideably disposed in said cylinder and having such a length that it can close off completely the charge pipe as feeding into the cylinder, or freeing the charge pipe to permit full charge flow from the charge pipe; and stop means included in the cylinder to establish a definite closing position for the charge pipe.

2. Device as in claim 1, said piston is made of a ceramic monolithic plug.

* * * * *